US007918575B2

(12) United States Patent
Ho

(10) Patent No.: US 7,918,575 B2
(45) Date of Patent: Apr. 5, 2011

(54) HIGH-POWER LED LIGHT BASE STRUCTURE

(76) Inventor: Yen-Wei Ho, Taichung (TW)

( * ) Notice: Subject to any disclaimer, the term of this patent is extended or adjusted under 35 U.S.C. 154(b) by 154 days.

(21) Appl. No.: 12/292,003

(22) Filed: Nov. 10, 2008

(65) Prior Publication Data

US 2010/0073941 A1 Mar. 25, 2010

(30) Foreign Application Priority Data

Sep. 19, 2008 (TW) ..... 97217018 U

(51) Int. Cl.
*G09F 13/04* (2006.01)

(52) U.S. Cl. ..... 362/97.3; 362/249.02; 362/249.06; 362/800; 313/500

(58) Field of Classification Search ..... 362/97.3, 362/240, 249.02, 249.06, 545, 800; 313/500
See application file for complete search history.

(56) References Cited

U.S. PATENT DOCUMENTS 7,285,903 B2 * 10/2007 Cull et al. ..... 313/500
7,654,702 B1 * 2/2010 Ding et al. ..... 362/249.02
2009/0027883 A1 * 1/2009 Koike et al. ..... 362/249.01

* cited by examiner

*Primary Examiner* — Stephen F Husar
(74) *Attorney, Agent, or Firm* — Raymond Y. Chan; David and Raymond Patent Firm

(57) ABSTRACT

This invention proposes a high-power LED light base structure, which has a base plate, and at least one set of V-shape mounting module that comprises first and second slant faces for mounting LED purposes. And, there are upper and lower horizontal plates set between the first and second slant faces so as keep LED modules properly spaced. It is in such manner that the beams emitted from LED modules mounted in first and second slant faces interlace each other so as to have enhanced and uniform brightness.

18 Claims, 6 Drawing Sheets

HIGH-POWER LED LIGHT BASE STRUCTURE

BACKGROUND OF THE INVENTION

Please refer to the FIG. 7 for prior art "High-power and high-efficiency LED lamp". The prior art has a base body 160 that comprises multiple symmetrical mounting faces for purpose of mounting LED modules. The included angle (A) between the closest mounting face 1600 and the normal line 160 of the base body is 76°~86°, the included angle (B) between the 2nd closest mounting face 1601 and the normal line 160 of the base body is 49°~59°, and the included angle (C) between the 3rd closest mounting face 1602 and the normal line 160 of the base body is 37°~47°. With aforementioned structure, the prior art aims to make the LED beam disperse so as to broaden the lighting range. However, such design makes the drawback of being too thick in dimension.

Another prior art "LED lamp structure" (as shown in FIG. 8) has a base body 100 that comprises a concaved mounting face 110 for purpose of mounting multiple LEDs 200 on it. Due to the concaved face, the mounted LEDs 200 face towards their center so as to have interlaced LED beam to broaden the lighting range. However, it also has same drawback as the abovementioned prior art.

With long time investments in researches and experiments, the inventor finally found an improved structure that can prevent aforementioned problems that prior arts encounter, and thus hereby proudly files application of patent to protect intellectual property.

BRIEF SUMMARY OF THE INVENTION

This invention proposes a high-power LED light base structure. The light base has a base plate, and at least one set of V-shape (outward-V looking) mounting module that comprises first and second slant faces for mounting LED purposes. It is in such manner that the beams emitted from LEDs mounted in first and second slant faces interlace each other so as to have enhanced and uniform brightness.

One feature of this invention is that the included angle between the base plate and first slant face is same as that between the base plate and second slant face. As another design of course, that the included angle between the base plate and first slant face can be different from that between the base plate and second slant face.

Inside any V-shape mounting module, there is a horizontal plate (hereafter called upper plate) set between the first and second slant faces. And, there is also a horizontal plate (hereafter called lower plate) set between any two V-shape mounting modules. Both the upper and lower plates are facilitated to provide proper spaces between any two first and second slant faces so that LED beams can embrace higher uniformity and brightness.

DETAILED DESCRIPTION OF THE INVENTION

Figure 1:
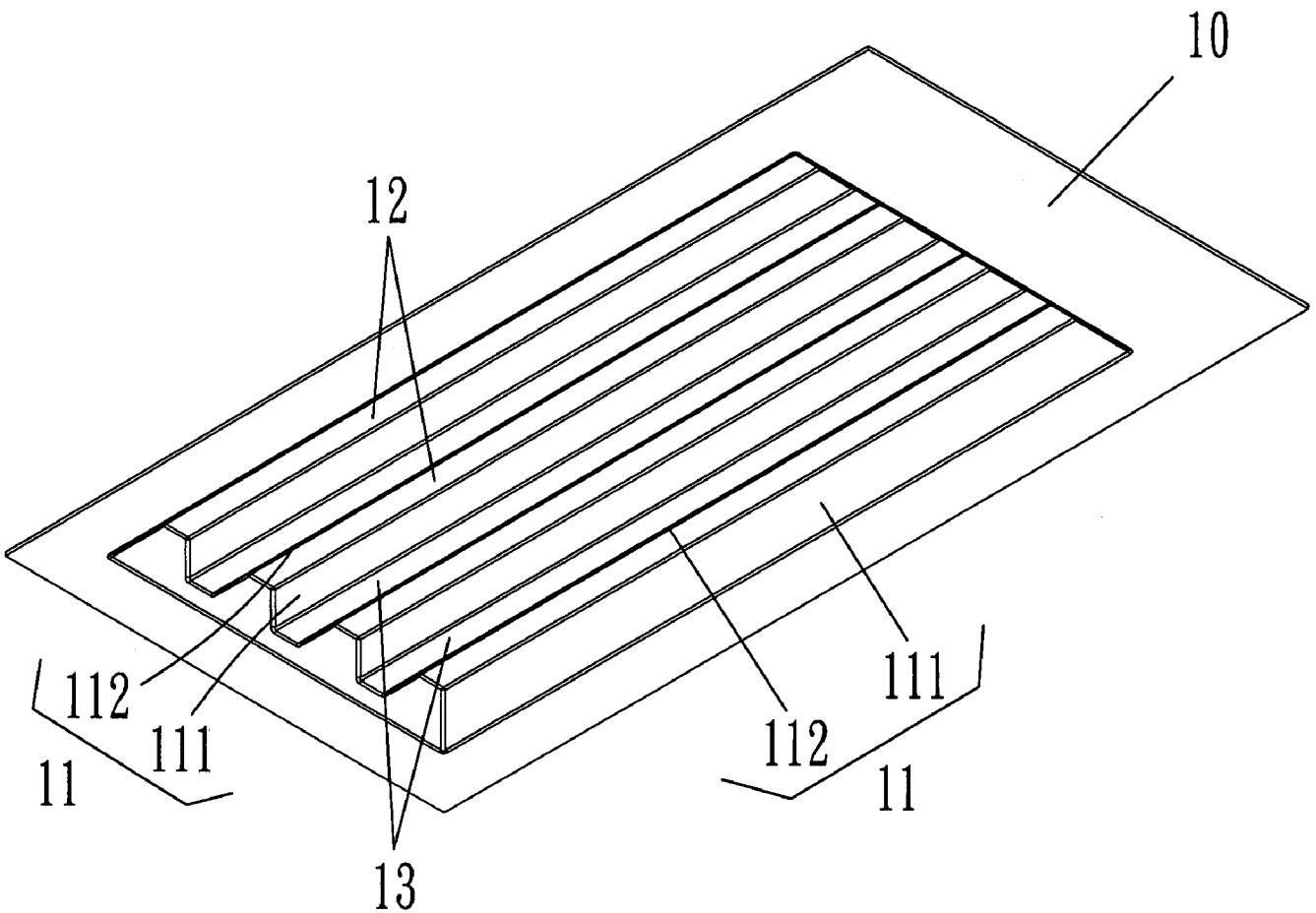
FIG. 1—-A 3-D view of the preferred embodiment
Figure 2:
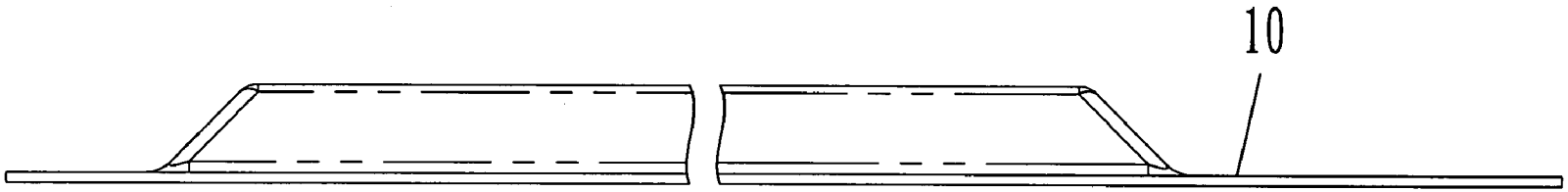
FIG. 2—A side view of the preferred embodiment
Figure 3:
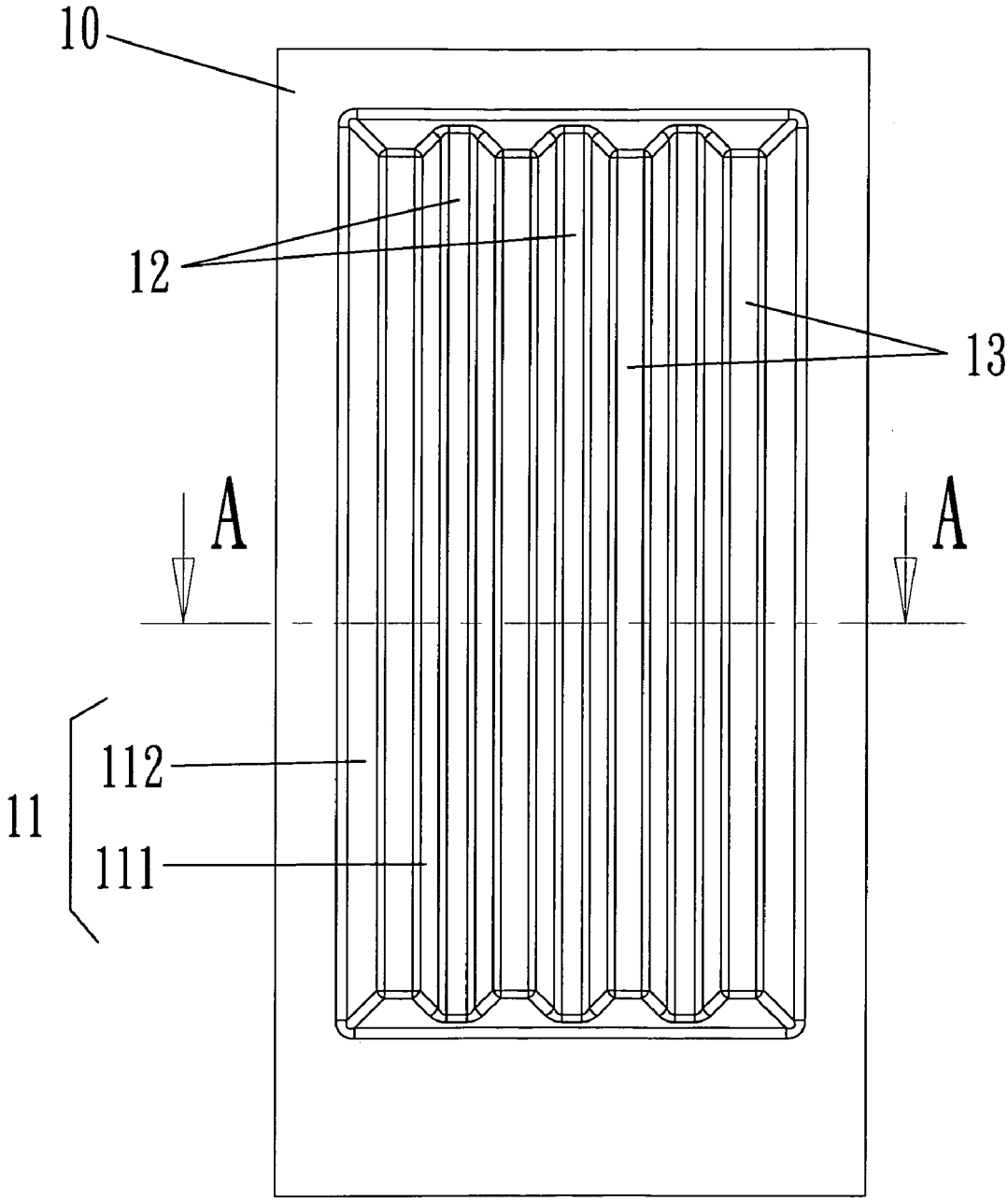
FIG. 3—A bird view of the preferred embodiment
Figure 4:
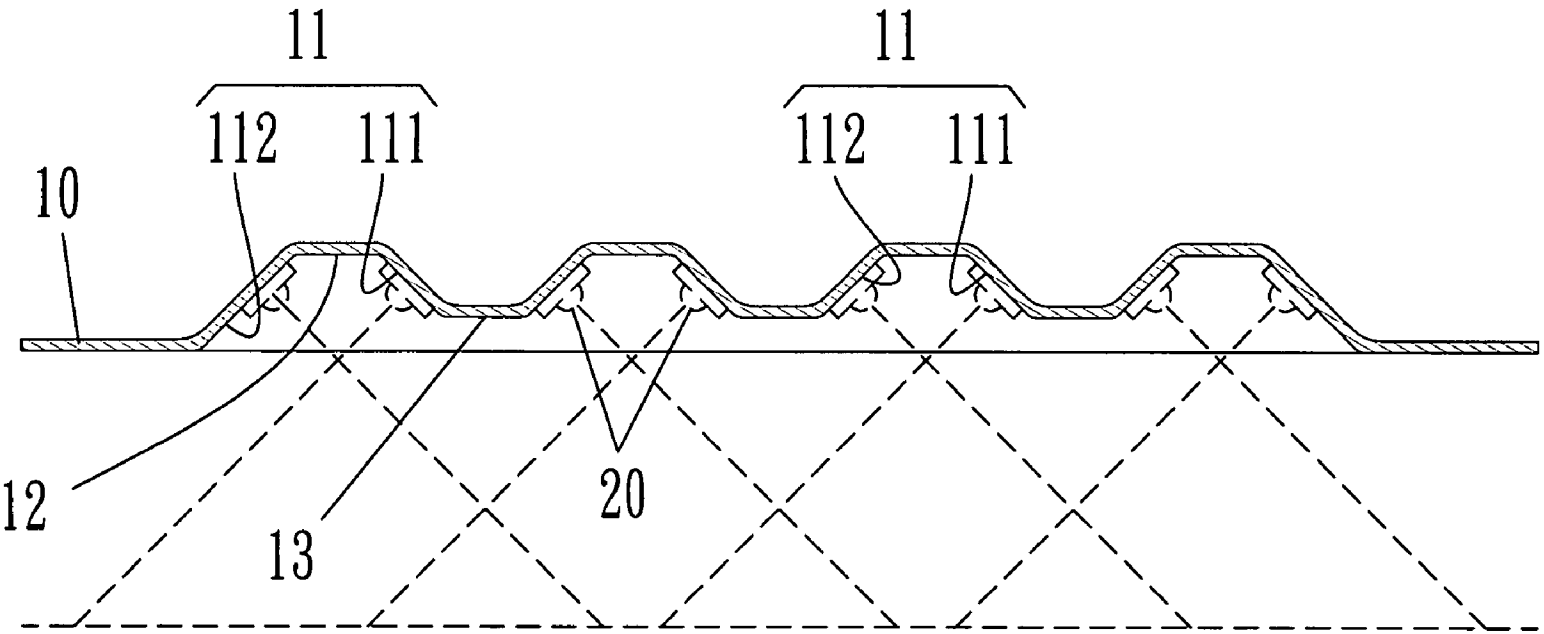
FIG. 4—A sectional view of the preferred embodiment before use

First, please refer to FIGS. 1-4 and following descriptions for the preferred embodiment for the invention of "A high-power LED light base structure" that comprises:

a base plate 10, at least one V-shape mounting module 11 that further comprises rectangular first slant face 111, and second slant face 112 for mounting LED module 20. It is in such manner that the beams emitted from LED 20 mounted in first and second slant faces interlace each other so as to have enhanced and uniform brightness.

Figure 5:
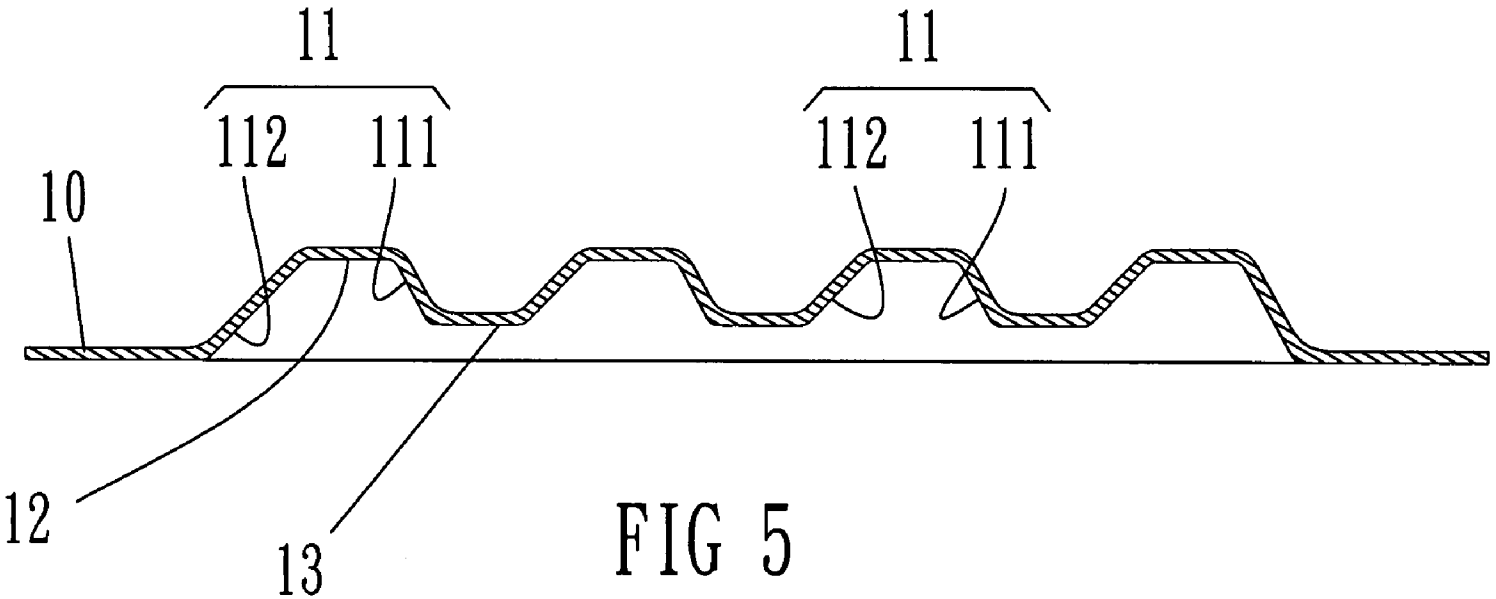
FIG. 5—A sectional view of the 2nd preferred embodiment

Moreover, the included angle between the base plate 10 and first slant face 111 is same as that between the base plate 10 and second slant face 112. As another design (shown in FIG. 5), the included angle between the base plate 10 and first slant face 111 can be different from that between the base plate 10 and second slant face 112.

Furthermore, inside any V-shape mounting module 11, there is a horizontal plate (hereafter called upper plate 12) set between the first and second slant faces 111, 112. And, there is also a horizontal plate (hereafter called lower plate 13) set between any two adjacent V-shape mounting modules 11. Both the upper and lower plates 11, 12 are facilitated to provide proper spaces between any two first and second slant faces 111, 112 so that LED beams can embrace higher uniformity and brightness.

Figure 6:
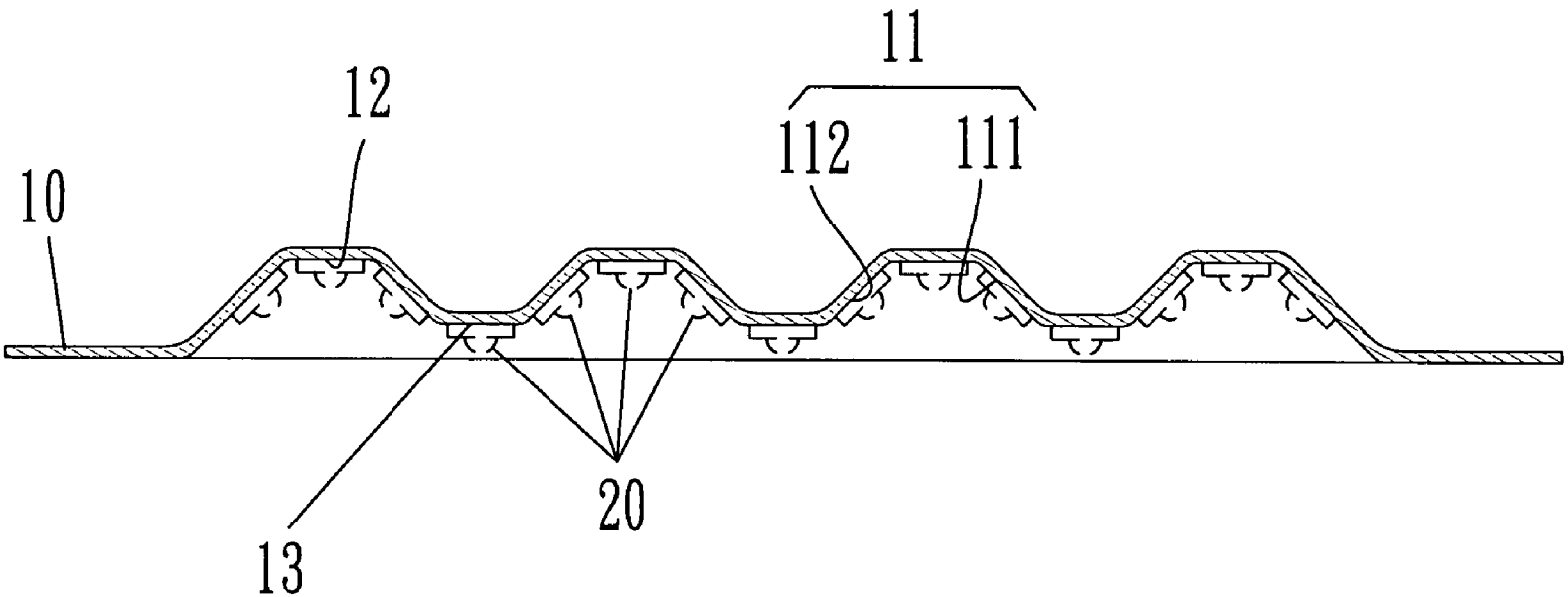
FIG. 6—A sectional view of the 2nd preferred embodiment before use

A shown in the FIG. 6, both the upper plate 12, and lower plate 13 can also mount with LED module 20. Together with the LED modules 20 mounted on the first and second slant faces 111, 112, the total brightness can be thus greatly enhanced.

With all aforementioned, the invention deserves grant of a patent based on its capability of industrial application and absolute novelty. The example illustrated above is just an exemplary embodiment for the invention, and shall not be utilized to confine the scope of the patent. Any equivalent modifications within the scope of claims of the patent shall be covered in the protection for this patent.

What is claimed is:

1. A high-power LED light base structure for mounting a plurality of LED modules, comprising:

a plurality of mounting modules, each of said mounting modules has a rectangular first slant face and a second slant face for mounting the plurality of LED modules on said first slant face and said second slant face directly such that beams emitted from the LED modules directly mounted on said first slant face and said second slant face interlace each other to embrace higher uniformity and brightness;

an upper plate between said slant face and said second slant face for each of said corresponding mounting modules, wherein said upper plate is a horizontal plate such that an upper end of said corresponding first slant face is connected to an upper end of said corresponding second slant face through said upper plate to provide a horizontal mounting surface at an upper end of each said corresponding mounting module; and a lower plate mounting between two said adjacently positioned mounting modules, wherein said lower plate is a horizontal plate such that a lower end of said corresponding first slant face is connected to a lower end of said corresponding second slant face through said lower plate to provide a horizontal mounting surface at a lower end between two said adjacently positioned mounting modules, whereby said first slant face, said second slant face, said upper plate and said lower plate forms a continuous mounting surface of said light base structure extended between two opposite sides of said light base structure for mounting the LED modules directly such that a thickness of said light base structure, which is sized for mounting one LED module on said upper plate, is arranged for providing four mounting surfaces without increasing the thickness of said light base structure and an overall brightness for said plurality of LED modules is increased.

2. The high-power LED light base structure, as recited in claim 1, wherein an included angle of said first slant face and an included angle of said second slant face are the same.

3. The high-power LED light base structure, as recited in claim 1, wherein an included angle of said first slant face and an included angle of said second slant face are different.

4. The high-power LED light base structure, as recited in claim 1, wherein said upper plate and said lower plate are horizontally positioned, whereby said upper plate and said lower plate define two horizontal and parallel plate levels with respect to said LED light base structure.

5. The high-power LED light base structure, as recited in claim 2, wherein said upper plate and said lower plate are horizontally positioned, whereby said upper plate and said lower plate define two horizontal and parallel plate levels with respect to said LED light base structure.

6. The high-power LED light base structure, as recited in claim 3, wherein said upper plate and said lower plate are horizontally positioned, whereby said upper plate and said lower plate define two horizontal and parallel plate levels with respect to said LED light base structure.

7. The high-power LED light base structure, as recited in claim 4, wherein a vertical distance between said lower plate and said LED light base structure is sized to fit one LED module.

8. The high-power LED light base structure, as recited in claim 5, wherein a vertical distance between said lower plate and said LED light base structure is sized to fit one LED module.

9. The high-power LED light base structure, as recited in claim 6, wherein a vertical distance between said lower plate and said LED light base structure is sized to fit one LED module.

10. A high-power LED light, comprising:

a plurality of LED modules; and a LED light base structure for mounting said plurality of LED modules, which comprises:

a plurality of mounting modules, each of said mounting modules has a rectangular first slant face and a second slant face, wherein said plurality of LED modules are mounted on said first slant face and said second slant face directly such that beams emitted from the LED modules mounted on said first slant face and said second slant face interlace each other to embrace higher uniformity and brightness;

an upper plate provided between said slant face and said second slant face for each of said corresponding mounting modules, wherein said upper plate is a horizontal plate such that an upper end of said corresponding first slant face is connected to an upper end of said corresponding second slant face through said upper plate to provide a horizontal mounting surface at an upper end of each said corresponding mounting module; and a lower plate mounting between two said adjacently positioned mounting modules, wherein said lower plate is a horizontal plate such that a lower end of said corresponding first slant face is connected to a lower end of said corresponding second slant face through said lower plate to provide a horizontal mounting surface at a lower end between two said adjacently positioned mounting modules, whereby said first slant face, said second slant face, said upper plate and said lower plate forms a continuous mounting surface of said light base structure extended between two opposite sides of said light base structure for mounting the LED modules directly such that a thickness of said light base structure, which is sized for mounting one LED module on said upper plate, is arranged for providing four mounting surfaces without increasing the thickness of said light base structure and an overall brightness for said plurality of LED modules is increased.

11. The high-power LED light, as recited in claim 10, wherein an included angle of said first slant face and an included angle of said second slant face are the same.

12. The high-power LED light, as recited in claim 10, wherein an included angle of said first slant face and an included angle of said second slant face are different.

13. The high-power LED light, as recited in claim 10, wherein said upper plate and said lower plate are horizontally positioned, whereby said upper plate and said lower plate define two horizontal and parallel plate levels with respect to said LED light base structure.

14. The high-power LED light, as recited in claim 11, wherein said upper plate and said lower plate are horizontally positioned, whereby said upper plate and said lower plate define two horizontal and parallel plate levels with respect to said LED light base structure.

15. The high-power LED light, as recited in claim 12, wherein said upper plate and said lower plate are horizontally positioned, whereby said upper plate and said lower plate define two horizontal and parallel plate levels with respect to said LED light base structure.

16. The high-power LED light, as recited in claim 13, wherein a vertical distance between said lower plate and said LED light base structure is sized to fit one LED module.

17. The high-power LED light, as recited in claim 14, wherein a vertical distance between said lower plate and said LED light base structure is sized to fit one LED module.

18. The high-power LED light, as recited in claim 15, wherein a vertical distance between said lower plate and said LED light base structure is sized to fit one LED module.

* * * * *